US007299577B2

(12) United States Patent
Bisson et al.

(10) Patent No.: US 7,299,577 B2
(45) Date of Patent: Nov. 27, 2007

(54) ILLUMINATED IDENTIFICATION SYSTEM

(76) Inventors: David Bisson, 8725 Londonshire Dr., Charlotte, NC (US) 28216; David Hanson, 434 Adelle Dr., Sagamore Hills, NC (US) 44067

( * ) Notice: Subject to any disclaimer, the term of this patent is extended or adjusted under 35 U.S.C. 154(b) by 307 days.

(21) Appl. No.: 10/695,362

(22) Filed: Oct. 28, 2003

(65) Prior Publication Data

US 2004/0083634 A1 May 6, 2004

Related U.S. Application Data

(60) Provisional application No. 60/422,086, filed on Oct. 29, 2002.

(51) Int. Cl.
*G09F 23/00* (2006.01)

(52) U.S. Cl. ..... 40/566; 40/564

(58) Field of Classification Search ..... 40/564, 40/566, 572, 575, 580
See application file for complete search history.

(56) References Cited

U.S. PATENT DOCUMENTS 4,587,753 A * 5/1986 Harper ..... 40/451
4,611,265 A * 9/1986 Davis ..... 362/145
4,843,525 A * 6/1989 Williams ..... 362/157
4,901,461 A * 2/1990 Edwards et al. ..... 40/575
5,649,378 A * 7/1997 Roesser et al. ..... 40/559
6,017,131 A * 1/2000 Goins ..... 362/249
6,060,838 A * 5/2000 Cantoni et al. ..... 315/159

* cited by examiner

*Primary Examiner*—Cassandra Davis
(74) *Attorney, Agent, or Firm*—Kathleen K Bowen

(57) ABSTRACT

An illuminated identification system comprises a light chamber, a lighting means, an opaque identification stencil, a flashing means, a power on/off switch for the lighting means, and an on/off switch for the flashing means. The light chamber is environmentally sealed, and has one surface which is non-opaque. The lighting means is in series with a power source, and is located in the light chamber. The opaque identification stencil is placed over the non-opaque light chamber surface. When the power switch and the flashing means are both on, the flashing means causes the lighting means to flash on and off. Further, the power switch, and/or the on/off switch for the flashing means, may be operated by remote control.

15 Claims, 4 Drawing Sheets

(Sect A-A)

ILLUMINATED IDENTIFICATION SYSTEM

CROSS-REFERENCE TO RELATED APPLICATIONS

This application claims the benefit of U.S. Provisional Application No. 60/422,086, filed Oct. 29, 2002.

BACKGROUND

The present invention is in the field of home and business identification systems. More specifically this invention relates to illuminated address systems, and associated safety features.

Identifying a home or business when it is dark can be difficult, especially in rural areas where the streets are not lit. An address on a building or a mailbox can be difficult to spot while driving, even when there is some illumination. Several patents have dealt with illuminating an address so as to be more visible at night. For instance U.S. Pat. No. 5,048,210 by Taylor et al discloses a device for illuminating residence information which is a housing with a light source which is mountable on a lamppost. U.S. Pat. No. 5,911,524 by Wilton discloses an automated, illuminated address display and entrance light that includes a lighted address and a separate light for general illumination around the address area. U.S. Pat. No. 5,522,540 by Surman discloses a solar powered illuminated address number device and mailbox structure. U.S. Pat. No. 4,937,499 by Hunte discloses a photosensitive illuminated house sign.

Even illuminated however, a home or business identification can be difficult to see under lighting conditions such as dusk, or a semi-lit street. It can also be the case where an address is visible, but it is not noticeable for a variety of reasons such as its location, surroundings or even the inattentiveness of the person trying to locate it. A system for illuminating home or business identification is desired which would make the identification more easily noticeable. Further, it is desired to have an illumination system which could be remotely activated.

SUMMARY OF THE INVENTION

An illuminated identification system comprises a light chamber, a lighting means, an opaque identification stencil, a flashing means, a power on/off switch for the lighting means, and an on/off switch for the flashing means. The light chamber is environmentally sealed, and has one surface which is non-opaque. The lighting means is in series with a power source, and is located in the light chamber. The opaque identification stencil is placed over the non-opaque light chamber surface. When the power switch and the flashing means are both on, the flashing means causes the lighting means to flash on and off. Further, the power switch, and/or the on/off switch for the flashing means, may be operated by remote control.

DETAILED DESCRIPTION

Figure 1:
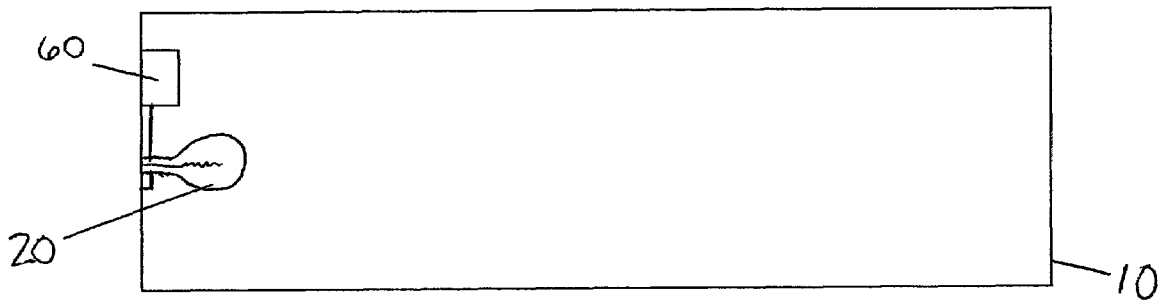
FIG. 1 is a side cross-sectional view of an illuminated identification system according to an aspect of the invention.
Figure 2:
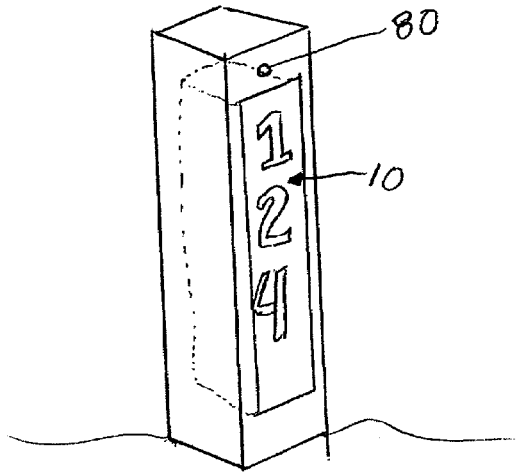
FIG. 2 is an isometric view of a yard post equipped with an illuminated identification system, according to an aspect of the invention.
Figure 3:
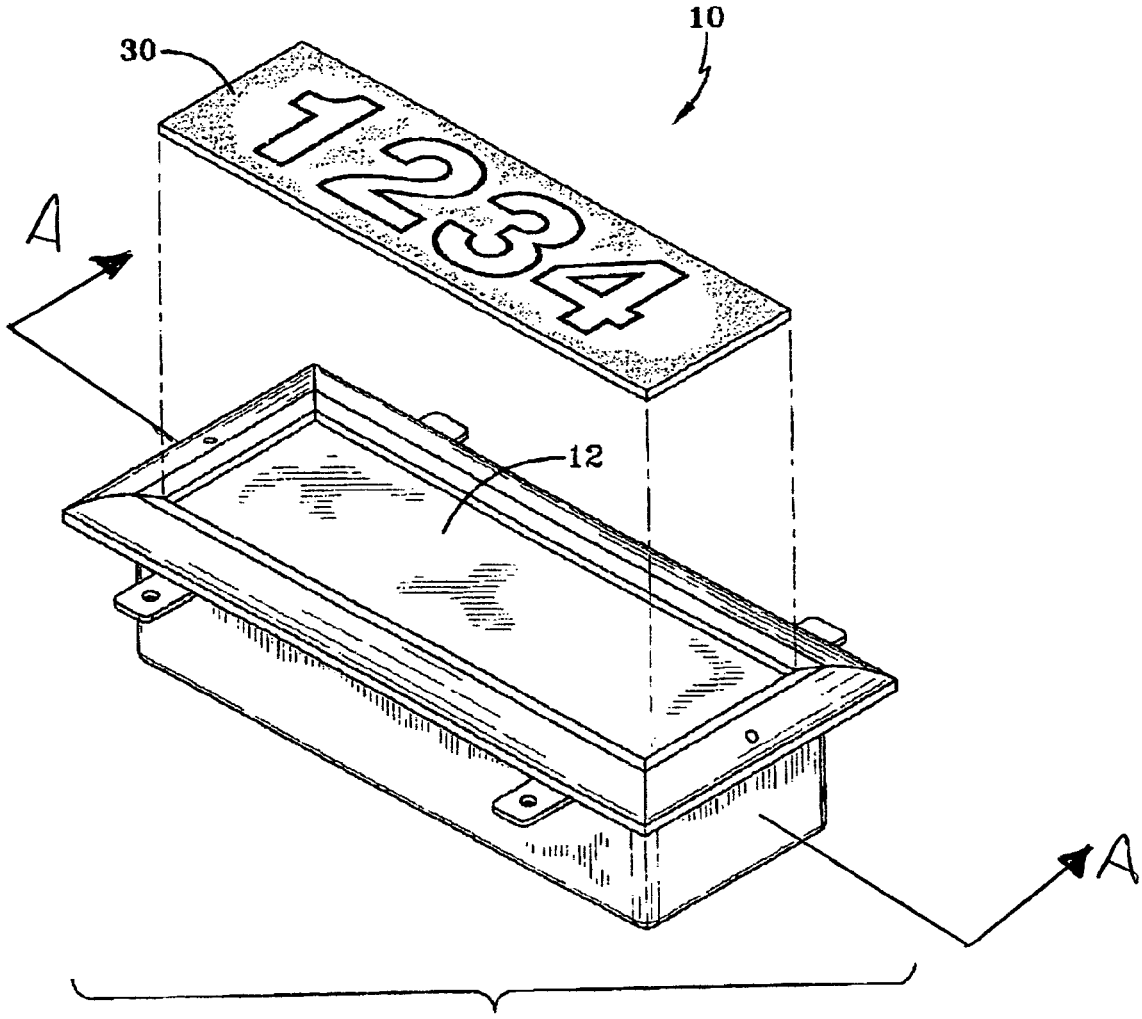
FIG. 3 is an isometric exploded view of an illuminated identification system, according to an aspect of the invention.
Figure 4:
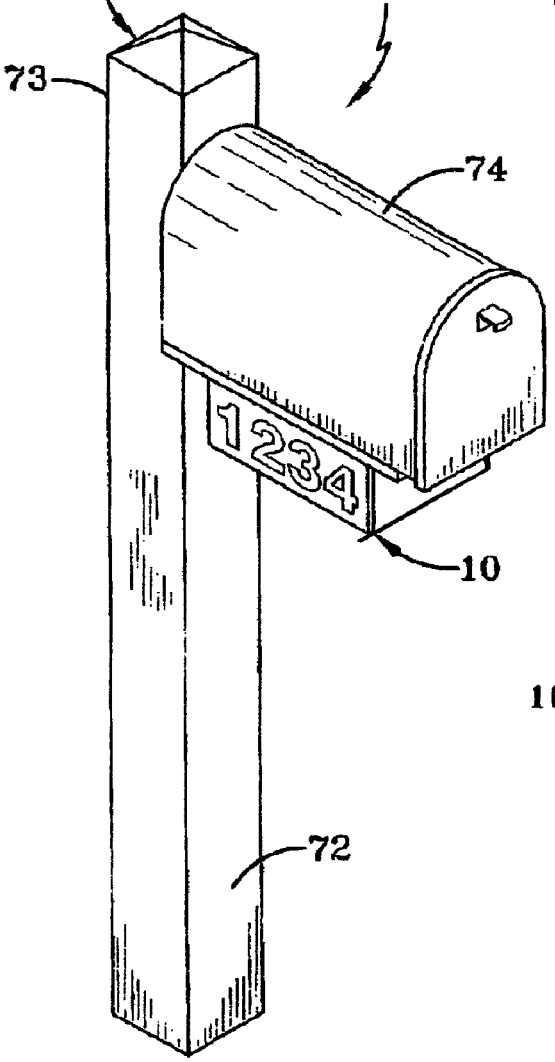
FIG. 4 is an isometric view of a mailbox assembly equipped with an illuminated identification system, according to an aspect of the invention.
Figure 5:
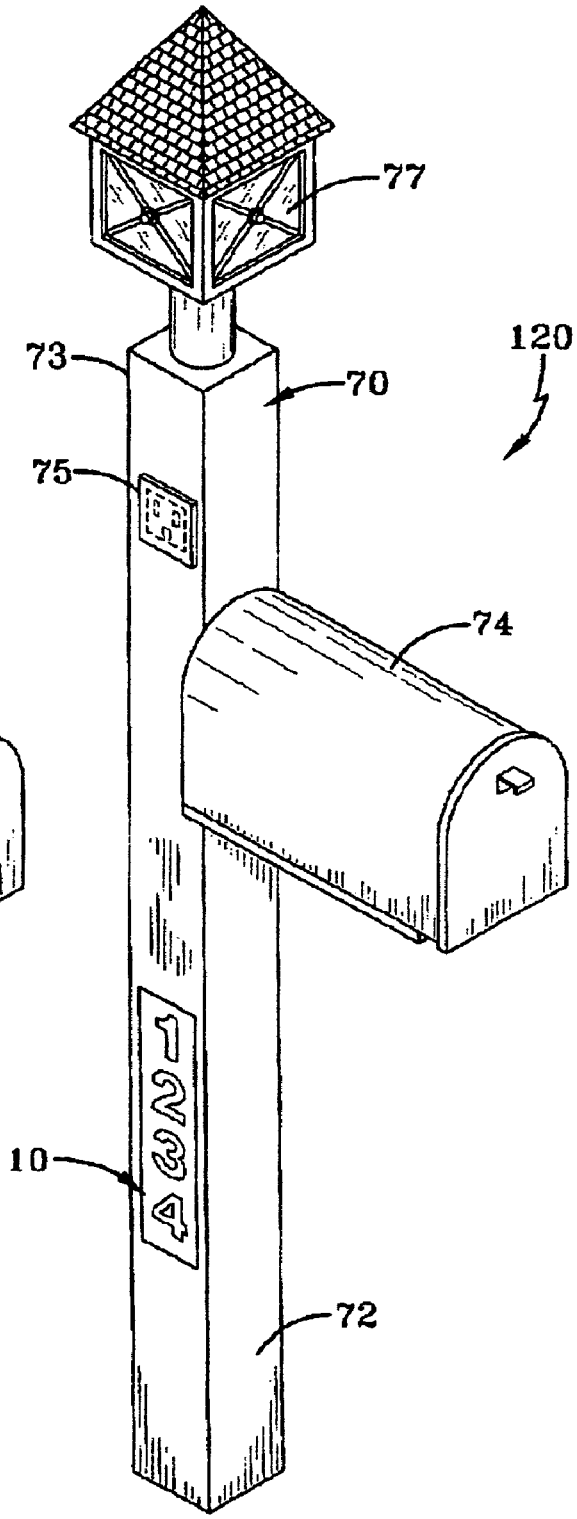
FIG. 5 is an isometric view of a mailbox assembly equipped with an illuminated identification system according to an aspect of the invention.
Figure 6:
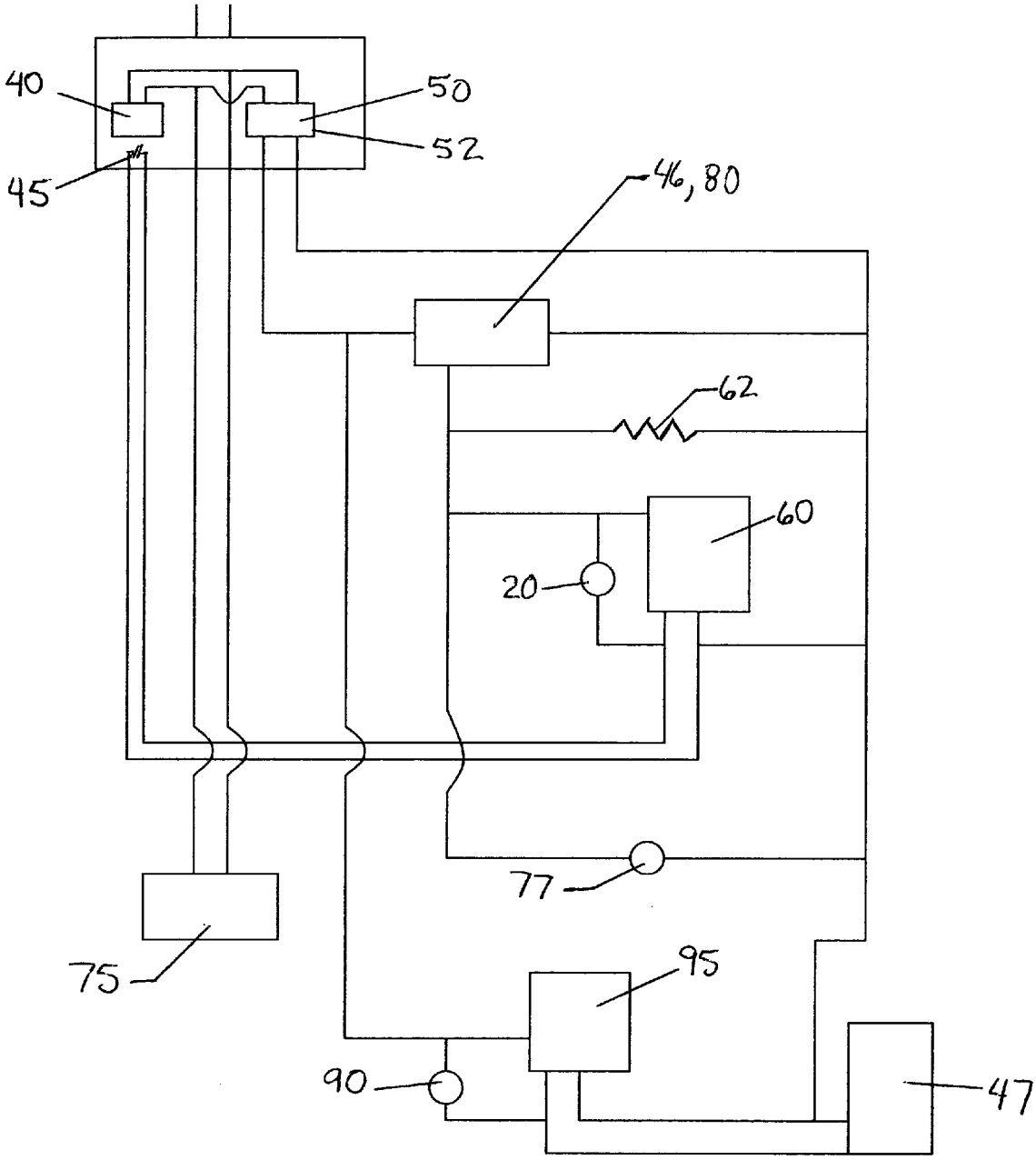
FIG. 6 is an electrical schematic for an illuminated identification system, according to an aspect of the invention.

Various aspects of the invention are presented in FIGS. 1-5 which are not drawn to scale and in which like components are numbered alike. Referring now to FIGS. 1-3, according to an aspect of the invention, an illuminated identification system 100 comprises an environmentally sealed light chamber 10, a lighting means 20, an opaque stencil 30, a flashing means 60 connected in series with the power source 50, a first switch 45, and a second switch 46. This system may be installed in a post in the yard, a mailbox, or even directly on the home or business.

The light chamber 10 has a surface 12 which is non-opaque, and the opaque stencil 30 is placed over the non-opaque light chamber surface 12. The lighting means 20 is in series with a power source 50, and is in the light chamber 10. The first switch 45 is in parallel with the flashing means 60, such that when the first switch 45 is closed, power flows from the power source 50 to the lighting means 20, and bypasses the flashing means 60. When the first switch 45 is open, power flows from the power source 50 to the lighting means 20, and through the flashing means 60, causing the lighting means 20 to flash on and off. This allows the home or business identification to be easily noticeable even at dusk or on well-lit streets, where a lighted identification alone may not be sufficient to attract the appropriate attention. The second switch 46 is in series with the power source 50, such that when the second switch 46 is open, power does not flow to the lighting means 20, and when the second switch 46 is closed, power flows to the lighting means 20. The components of the illuminated identification system 100 other than the lighting means 20 may be mounted inside the light chamber 10, or may be mounted external to the light chamber 10. For example, if the illuminated identification system 100 is used on a house or other building, the components may be mounted to the house/building. If the illuminated identification system 100 is used in a post in the yard (see FIG. 2), the components may be mounted internal to the post, but external to the light chamber 10.

According to a further aspect of this invention, this illuminated identification system 100 is installed on a mailbox assembly.

In a preferred embodiment, second switch 46 comprises a photocell 80, which is open when it is daylight, and is closed when ambient light reaches a predetermined level. This allows the lighting means to be lit from dusk to dawn, and turned off during the day, without any operator action.

According to another aspect of the invention, the illuminated identification system 100 further comprises a remote control receiver 40, in series with a power source 50, wherein the remote control receiver 40 controls the first switch 45; and, a remote control 42, which controls the remote control receiver 40. The remote control receiver 40 may be located on the light chamber 10, or it may be remotely located. If the remote control receiver 40 is operating on 110 VAC power, it might be beneficial to locate the receiver somewhere on the premises, so that 110 VAC lines need not be brought to the light chamber 10.

In addition to the lighting means 20 located in the light chamber 10, according to a further aspect of the invention an external light 77, external to the light chamber 10 may be used. Thus for example a carriage light may be mounted on the top of a post, housing the light chamber 10. This external light 77 is in series with the power source 50. In a preferred embodiment, the external light 77 is further in series with the second switch 46, such that the second switch 46 is between the external light 77 and the power source 50, and further the external light 77 is in parallel with the flashing means 60.

When the illuminated identification system 100 is not located on the house or building, power must be brought to it. Thus, according to an aspect of the invention, the power source 50 may be a battery. According to a further aspect of the invention, the power source 50 may be a capacitor charged by a solar array. These are intended as examples, and in no way limit the power source, as any appropriate power source is within the purview of this invention.

In order to have a continuous supply of power that will not have to be replaced, and is reliable, power will be brought from the home/building to the illuminated identification system. This power source can be the 110 VAC typically used by homes; however, there are safety codes which require certain handling of this type of power. For example, a typical code would require 110 VAC lines to be buried 12 inches underground, and 18 inches when going under a sidewalk or driveway. Some local codes even require the buried lines to be in conduit. This can be very expensive and time consuming. In order to avoid these problems, in a preferred embodiment of the invention the power source 50 is a low voltage 12 VAC power source. According to an aspect of the invention, the low voltage power source originates from a standard 110 VAC power source which is routed through a low voltage transformer 52.

Even with a low voltage transformer 52 rated as 12 VAC, the actual voltage output is something less than 12 VAC, typically around 7-8 VAC. This voltage is acceptable for the lighting means, but is a problem for the remote control receiver 40, and the photocell/flashing means combination. In order for the photocell to function, it needs a minimum load of impedance across its terminals. This was calculated as the voltage squared divided by the resistance of the flashing means 60. With an Amperite Co., model # 12F30XB flashing means 60, this worked out to be approximately 1.6 watts. This could vary depending on the specific flashing means 60 used. Therefore a 2 watt, 100 ohm resistor would ensure that the photocell 80 and flashing means 40 operate correctly with a 20% safety factor. Therefore according to a further aspect of the invention, a resistor 62 is in parallel with the flashing means 60. In a preferred embodiment of the invention, the resistor 62 is approximately 100 ohms. One type of low voltage photocell 80 which may be used is an Intermatic Incorporated model # LV814PR. This is just an example of a photocell that may be used, as any appropriate photocell is within the purview of the invention.

According to an aspect of the invention, the remote control receiver 40, may be a 110 V receiver which acts to energize a 110 V relay, wherein the 110 VAC relay is the first switch 45. Currently there are no relays on the market which will operate on only 7-8 VAC. Therefore, according to an aspect of the invention, the remote control receiver 40 is remotely located from the light chamber 10. Thus, the remote control receiver 40 may be located at the house/building, while the light chamber 10 is located elsewhere. In a preferred embodiment of the invention, the remote control receiver 40 is located in the same box as the low voltage transformer 52.

According to another aspect of the invention, the illuminated identification system 100 further comprises a red emergency light 90, wherein the red emergency light 90 is in series with the power source 50, a second flashing means 95, and a third switch 47, wherein the red emergency light 90 is in series with the third switch 47, but not in series with the first switch 45 or the second switch 46. According to an aspect of this invention, the third switch 95 may be controlled manually by a switch in the home or building. According to a further aspect of the invention, the third switch 47 is controlled by an external alarm system. This red emergency light allows the police or fire department to determine that there is an emergency, rather than someone waiting for a delivery or a guest.

According to a further aspect of the invention, a mailbox assembly with an illuminated identification system integral thereto 120, comprises an environmentally sealed light chamber 10, a lighting means 20, an opaque identification stencil 30, a flashing means 60 connected in series with the power source 50, a first switch 45, a second switch 46, and a mailbox assembly 70. The mailbox assembly 70 has a post portion 72, and a box portion 74, and has been adapted to accommodate the light chamber 10. The illuminated identification system functions essentially the same when integrated thusly into a mailbox assembly.

In another embodiment, the mailbox assembly 70 has been adapted to accommodate the light chamber 10 in the post portion 72. In a preferred embodiment, the post portion is built from Mantex fiberglass resin board, as this material has the desired durable, environmentally resistant properties desired, although any suitable material is within the purview of this invention.

In a further embodiment, the mailbox assembly 70 has been adapted to accommodate the light chamber 10 in the box portion 74. One such adaptation comprises mounting the light chamber 10 to the underside of the box portion 74. A further adaptation has the light chamber 10 resting on a shelf which has been installed below the box portion 74.

In a preferred embodiment of the invention the mailbox post portion 72 has a base 71 which is secured to the ground, and an upper portion 73 which supports the box portion 74, and further comprises a standard electrical outlet 75 mounted into the upper portion 73. The electrical outlet 75 is in series with the power source 50, such that the power source 50 is a standard AC source in series with the electrical outlet 75. This electrical outlet may then be used to plug in outdoor equipment, lights, etc.

The mailbox assembly with integral illuminated identification system may further comprise an external light 77 such as a coach light, wherein the external light 77 is wired in series with the power source 50. In a preferred embodiment of the invention, the external light 77 is further in series with the second switch 46.

As can be seen by the varieties mentioned, there are many ways in which this invention can be utilized. The system can go into a mailbox assembly; the mailbox assembly can have an electrical outlet so as to allow further access to the power supply; the mailbox assembly may further have a coach light. There are also many ways in which the unit can be wired; with the flasher alone, with the flasher and the photocell, with the remote control and the photocell, etc. The coach light can operate whenever power is supplied; it can flash when the lighting means is flashing. The unit can be remote control activated, or it can be hard wired to operate by a remote switch. Besides the many combinations, there are also many uses for this system, such as on a house or building, on a mailbox assembly, in a lighted identification post placed in a yard, or identifying a dock number or name. Any combinations of the elements disclosed are considered to be within the purview of the invention, even though they may all not be specifically enumerated.

In a further embodiment of the invention, the illuminated identification system 100 comprises an environmentally sealed light chamber 10 having a non-opaque surface 12, a lighting means 20, an opaque identification stencil 30, a remote control receiver 40, a second switch 46, and a remote control 42, wherein the remote control 42 activates the remote control receiver 40. The lighting means 20 is in series with a power source 50, and is in the light chamber 10. The opaque identification stencil 30 is placed over the non-opaque light chamber surface 12. The second switch 46 is controlled by the remote control receiver 40, and is in series with the lighting means 20, between the lighting means 20 and the power source 50, such that the remote control receiver 40 can either cause the second switch 46 to close, allowing power to flow to the lighting means 20, or cause the second switch 46 to open, preventing power from flowing to the lighting means 20. As above, this aspect of the invention may be combined with any of the other aspects of the invention, and still fall within the purview of this invention.

According to a further aspect of this invention, this illuminated identification system 100 is installed on a mailbox assembly.

According to an aspect of the invention, the opaque identification stencil 30 is a stencil of the home or business address. Any appropriate opaque stencil could be used and still be within the scope of the invention. For instance the opaque stencil could be the name of the homeowner, or of the business. This system could even be used on boat docks where the stencil might be the name of the boat, the dock number, or the name of the boat owner.

What is claimed is:

1. An illuminated identification system comprising:

a light chamber, wherein said light chamber is environmentally sealed, and wherein one surface of said chamber is non-opaque;

a lighting means, wherein said lighting means is in series with a power source, and wherein said lighting means is in said light chamber;

an opaque identification stencil, wherein said identification stencil is placed over said non-opaque light chamber surface;

a flashing means in series with said power source;

a first switch, wherein said first switch is in series with said flashing means, such that when said first switch is open power flows from said power source to said lighting means, and does not flow through said flashing means, and when said first switch is closed, power flows from said power source through said flashing means to said lighting means, causing said lighting means to flash on and off; and, a second switch, wherein said second switch is in series with said power source, such that when said second switch is open, power does not flow to said lighting means, and when said second switch is closed, power flows to said lighting means, and further comprising an external light mounted externally to said light chamber, wherein said external light is in series with said power source.

2. The illuminated identification system of claim 1 wherein said external light is further in series with said second switch, such that said second switch is between said external light and said power source, and in parallel with said flashing means.

3. An illuminated identification system comprising:

a light chamber, wherein said light chamber is environmentally sealed, and wherein one surface of said chamber is non-opaque;

a lighting means, wherein said lighting means is in series with a power source, and wherein said lighting means is in said light chamber;

an opaque identification stencil, wherein said identification stencil is placed over said non-opaque light chamber surface;

a flashing means in series with said power source;

a first switch, wherein said first switch is in series with said flashing means, such that when said first switch is open power flows from said power source to said lighting means, and does not flow through said flashing means, and when said first switch is closed, power flows from said power source through said flashing means to said lighting means, causing said lighting means to flash on and off; and, a second switch, wherein said second switch is in series with said power source, such that when said second switch is open, power does not flow to said lighting means, and when said second switch is closed, power flows to said lighting means, wherein said power source is a low voltage 12 VAC power source, and further comprising a low voltage transformer, wherein said low voltage power source originates from a standard 110 VAC power source which is routed through said low voltage transformer.

4. The illuminated identification system of claim 3 further comprising a resistor in parallel with said flashing means.

5. The illuminated identification system of claim 4 wherein said resistor is approximately 100 ohms.

6. The illuminated identification system of claim 3 wherein said low voltage transformer is remotely located from said light chamber.

7. An illuminated identification system comprising:

a light chamber, wherein said light chamber is environmentally sealed, and wherein one surface of said chamber is non-opaque;

a lighting means, wherein said lighting means is in series with a power source, and wherein said lighting means is in said light chamber;

an opaque identification stencil, wherein said identification stencil is placed over said non-opaque tight chamber surface;

a first flashing means in series with said power source;

a first switch, wherein said first switch is in series with said flashing means, such that when said first switch is open power flows from said power source to said lighting means, and does not flow through said flashing means, and when said first switch is closed, power flows from said power source through said flashing means to said lighting means, causing said lighting means to flash on and off; and, a second switch, wherein said second switch is in series with said power source, such that when said second switch is open, power does not flow to said lighting means, and when said second switch is closed, power flows to said lighting means; and, a red emergency light, wherein said red emergency light is in series with said power source;

a second flashing means, wherein said second flashing means is in series with said red emergency light, but not in series with said first flashing means, said first switch or said second switch; and, a third switch, wherein said third switch is in series with said red emergency light and said second flashing means, but not in series with said first switch or said second switch, and wherein said third switch is controlled by an external alarm system.

8. A mailbox assembly with an illuminated identification system integral thereto, comprising;

a light chamber, wherein said light chamber is environmentally sealed, and wherein one surface of said chamber is non-opaque;

a lighting means, wherein said lighting means is in series with a power source, and wherein said lighting means is in said light chamber;

an opaque identification stencil, wherein said identification stencil is placed over said non-opaque light chamber surface;

a mailbox, having a post portion, and a box portion, wherein said mailbox has been adapted to accommodate said light chamber;

a flashing means in series with said power source;

a first switch, wherein said first switch is in series with said flashing means, such that when said first switch is open power flows from said power source to said lighting means, and does not flow through said flashing means, and when said first switch is closed, power flows from said power source through said flashing means to said lighting means, causing said lighting means to flash on and off; and, a second switch, wherein said second switch is in series with said power source, such that when said second switch is open, power does not flow to said lighting means, and when said second switch is closed, power flows to said lighting means, wherein said mailbox post portion has a base which is secured to the ground, and a top which supports said box portion, further comprising a standard electrical outlet mounted into said base of said post portion, wherein said electrical outlet is in series with said lighting means and wherein said electrical outlet is located between the power source, and said lighting means.

9. A mailbox assembly with an illuminated identification system integral thereto, comprising;

a light chamber, wherein said light chamber is environmentally sealed, and wherein one surface of said chamber is non-opaque;

a lighting means, wherein said lighting means is in series with a power source, and wherein said lighting means is in said light chamber;

an opaque identification stencil, wherein said identification stencil is placed over said non-opaque light chamber surface;

a mailbox, having a post portion, and a box portion, wherein said mailbox has been adapted to accommodate said light chamber;

a flashing means in series with said power source;

a first switch, wherein said first switch is in series with said flashing means, such that when said first switch is open power flows from said power source to said lighting means, and does not flow through said flashing means, and when said first switch is closed, power flows from said power source through said flashing means to said lighting means, causing said lighting means to flash on and off; and, a second switch, wherein said second switch is in series with said power source, such that when said second switch is open, power does not flow to said lighting means, and when said second switch is closed, power flows to said lighting means, further comprising an external light mounted externally to said mailbox, wherein said external light is in series with said power source.

10. The mailbox assembly with integral illuminated identification system of claim 9 wherein said external light is further in series with said second switch.

11. A mailbox assembly with an illuminated identification system integral thereto, comprising;

a light chamber, wherein said light chamber is environmentally sealed, and wherein one surface of said chamber is non-opaque;

a lighting means, wherein said lighting means is in series with a power source, and wherein said lighting means is in said light chamber;

an opaque identification stencil wherein said identification stencil is placed over said non-opaque light chamber surface;

a mailbox, having a post portion, and a box portion, wherein said mailbox has been adapted to accommodate said light chamber;

a flashing means in series with said power source;

a first switch, wherein said first switch is in series with said flashing means, such that when said first switch is open power flows from said power source to said lighting means, and does not flow through said flashing means, and when said first switch is closed, power flows from said power source through said flashing means to said lighting means, causing said lighting means to flash on and off;

a second switch, wherein said second switch is in series with said power source, such that when said second switch is open, power does not flow to said lighting means, and when said second switch is closed, power flows to said lighting means; and, wherein said power source is a low voltage 12 VAC power source, further comprising a low voltage transformer, wherein said low voltage power source originates from a standard 110 VAC power source which is routed through said low voltage transformer.

12. The mailbox assembly with integral illuminated identification system of claim 11 further comprising a resistor in parallel with said flashing means.

13. The mailbox assembly with integral illuminated identification system of claim 12 wherein said resistor is approximately 100 ohms.

14. The mailbox assembly with integral illuminated identification system of claim 11 wherein said low voltage transformer is remotely located from said light chamber.

15. A mailbox assembly with an illuminated identification system integral thereto, comprising;

a light chamber, wherein said light chamber is environmentally sealed, and wherein one surface of said chamber is non-opaque;

a lighting means, wherein said lighting means is in series with a power source, and wherein said lighting means is in said light chamber;

an opaque identification stencil, wherein said identification stencil is placed over said non-opaque light chamber surface;

a mailbox, having a post portion, and a box portion, wherein said mailbox has been adapted to accommodate said light chamber;

a flashing means in series with said power source;

a first switch, wherein said first switch is in series with said flashing means, such that when said first switch is open power flows from said power source to said lighting means, and does not flow through said flashing means, and when said first switch is closed, power flows from said power source through said flashing means to said lighting means, causing said lighting means to flash on and off; and, a second switch, wherein said second switch is in series with said power source, such that when said second switch is open, power does not flow to said lighting means, and when said second switch is closed, power flows to said lighting means, further comprising;

a red emergency light, wherein said red emergency light is in series with said power source; and, a switch five, wherein said red emergency light is in series with said switch five, but not in series with said first switch or said second switch, and wherein said switch five is controlled by an external alarm system.

* * * * *